US010926844B1

(12) United States Patent
Hyun

(10) Patent No.: US 10,926,844 B1
(45) Date of Patent: Feb. 23, 2021

(54) CHAIR FOR SHIP WITH HORIZONTALITY MAINTAINING STRUCTURE

(71) Applicant: Chong Man Hyun, Jeju-do (KR)

(72) Inventor: Chong Man Hyun, Jeju-do (KR)

( * ) Notice: Subject to any disclaimer, the term of this patent is extended or adjusted under 35 U.S.C. 154(b) by 0 days.

(21) Appl. No.: 16/600,374

(22) Filed: Oct. 11, 2019

(51) Int. Cl.
*B63B 29/12* (2006.01)
*A47C 3/22* (2006.01)
*B63B 29/04* (2006.01)

(52) U.S. Cl.
CPC ..... *B63B 29/12* (2013.01); *A47C 3/22* (2013.01); *B63B 2029/043* (2013.01)

(58) Field of Classification Search
CPC ..... B63B 29/12; B63B 29/04; B63B 29/06; B63B 2029/043; A47C 3/22
USPC .... 297/217.7, 310, 311, 312, 313, 314, 325, 297/326; 248/371; 114/191, 194
See application file for complete search history.

(56) References Cited

U.S. PATENT DOCUMENTS 1,220,553 A * 3/1917 Rastija ..... B63B 29/12 114/194
1,970,630 A * 8/1934 Searing ..... B63B 29/12 114/191
2,195,428 A * 4/1940 Searing ..... B63B 29/12 114/194
2,740,599 A * 4/1956 Roberts-Horsfield, Jr. ..... B64C 17/06 244/122 R
3,341,165 A * 9/1967 Quinton ..... B60N 2/507 248/550
3,466,089 A * 9/1969 Stueckle ..... B60N 2/39 297/314
3,863,587 A * 2/1975 Bosnich ..... B63B 29/12 114/191
5,669,324 A * 9/1997 Muir, III ..... B63B 29/12 114/194
5,795,078 A * 8/1998 Li ..... F16C 19/50 384/498
5,857,535 A * 1/1999 Brooks ..... B60N 2/39 180/41
6,257,663 B1 * 7/2001 Swierczewski ..... B60N 2/4214 297/216.16
10,046,677 B2 * 8/2018 Parker ..... B60N 2/38
(Continued)

FOREIGN PATENT DOCUMENTS

EP 2899063 * 1/2014
GB 525036 * 2/1938
(Continued)

*Primary Examiner* — Mark R Wendell
(74) *Attorney, Agent, or Firm* — Intellectual Property Law Group LLP

(57) ABSTRACT

Provided is a chair for a ship with horizontality maintaining structure for preventing passengers on board the ship from getting motion sickness by maintaining the horizontality of the chair installed in cabins and the like in response to wobbles of the ship. The chair for a ship with horizontality maintaining structure according to the present disclosure includes an external frame 10 which is installed in a fixing way on the hull floor; an internal frame 20 which is integrated inside the external frame 10 so that it rotates back and forth; a seat unit 30 which is integrated inside the internal frame 20 so that it rotates from side to side; and a horizontality maintaining means 40 which is formed in the lower part of the seat unit 30.

7 Claims, 10 Drawing Sheets

(56) References Cited

U.S. PATENT DOCUMENTS

| | | | | |
|---|---|---|---|---|
| 2009/0091171 | A1* | 4/2009 | Valverde Fernandez | B60N 2/39 297/325 |
| 2012/0267503 | A1* | 10/2012 | Gribble | B60N 2/39 248/393 |

FOREIGN PATENT DOCUMENTS

| | | | |
|---|---|---|---|
| KR | 101657437 | B1 | 9/2016 |
| KR | 20160108725 | A | 9/2016 |

* cited by examiner

CHAIR FOR SHIP WITH HORIZONTALITY MAINTAINING STRUCTURE

BACKGROUND

1. Field of Invention

The present disclosure relates to a chair for a ship with horizontality maintaining structure, more particularly a chair for a ship with horizontality maintaining structure for preventing passengers on board the ship from getting motion sickness by maintaining the horizontality of the chair installed in cabins and the like in response to wobbles of the ship.

2. Description of the Related Art

Ships sailing on the sea experience, due to externally exerted waves, wind and the like, the phenomena of pitching or rolling, the wobbles of the ship up and down or from side to side, respectively, with respect to the direction the ship progresses in.

Chairs installed in cabins and the like wobble, being integrated with the floor of the ship, according to the phenomena of pitching or rolling while passengers seated in the chairs usually suffer from motion sickness when they shake according to the wobbles of the chairs.

Disclosed are prior art documents which maintain horizontality of chairs installed in cabins and the like in response to wobbles of ships. Korean Patent Registration No. 1657437, "MULTI-FUNCTIONAL BALANCE TABLE", discloses a multifunctional support having a plurality of supports, a connector which connects to the support, a horizontality maintaining hemisphere provided for the support, a horizontality maintaining means provided for the horizontality maintaining hemisphere, a shock absorbing means, and an upper plate table and an integration securing means provided for the horizontality maintaining means.

Korean Patent Publication No. 2016-0108725, "CHAIR FOR PREVENTION MOTION SICKNESS", discloses a chair for preventing motion sickness including a seating unit having a back and a seat, a horizontality maintaining unit which is connected to the lower part of the seat so that the seat of the seating unit keeps horizontal with the horizon and a supporting unit which is connected to the horizontality maintaining unit and fixed to the ship floor for supporting the horizontality maintaining unit.

Such kinds of prior art are hard to manufacture due to their complex structures and require high manufacturing costs. So as to rapidly disseminate technology for maintaining horizontality of chairs installed in cabins and the like in response to wobbles of ships sailing on the sea, chairs for ships having horizontality maintaining structure which is simple for easy manufacturing and manufacturing cost reduction need to be developed.

RELATED ART DOCUMENTS

Patent Literature (Patent Literature 1) Korean Patent Registration No. 1657437, "MULTI-FUNCTIONAL BALANCE TABLE" (Registered on Sep. 7, 2016)

(Patent Literature 2) Korean Patent Publication No. 2016-0108725, "CHAIR FOR PREVENTION MOTION SICKNESS" (Publicized on Sep. 20, 2016)

SUMMARY

The present disclosure provides a chair for a ship with horizontality maintaining structure for preventing passengers on board the ship from getting motion sickness by maintaining the horizontality of the chair installed in cabins and the like in response to wobbles of the ship.

The chair for a ship with horizontality maintaining structure provided by the present disclosure includes: an external frame 10 which is installed in a fixing way on the hull floor; an internal frame 20 which is integrated inside the external frame 10 so that it can rotate back and forth; a seat unit 30 which is integrated inside the internal frame 20 so that it can rotate from side to side; and a horizontality maintaining means 40 which is formed in the lower part of the seat unit 30, wherein the external frame 10 comprises: a left member 11 which is installed in a fixing way on the hull floor and has the shape of a quadrangle plate; and a right member 12 which has the same shape as that of the left member 11 and is installed in a fixing way on the hull floor with a certain distance from the left member 11 to be parallel with the left member 11; the internal frame 20 comprises: a back 21 which has the shape of a quadrangle plate; a left plate 22 which has the shape of a quadrangle plate and is installed in a fixing way on the left side of the back 21 so that the left plate protrudes therefrom; and a right plate 23 which has the same shape as that of the left plate 22 and is installed in a fixing way on the right side of the back 21 so that the right plate protrudes therefrom; the internal frame 20 is integrated between the left member 11 and the right member 12 of the external frame 10; a fastening hole 50 is formed at its predetermined corresponding location of the left member 11 of the external frame 10 and the left plate 22 of the internal frame 20 and the right member 12 of the external frame 10 and the right plate 23 of the internal frame 20, respectively; a fastening member 60 is inserted through the fastening hole 50 for the internal frame 20 to be integrated inside the external frame 10 so that the internal frame 20 can rotate back and forth; a fastening hole 70 is formed at its predetermined location at the center of the back 21 of the internal frame 20 while a fastening member 80 is inserted in the fastening hole 70 so that the seat unit 30 is integrated on the front side of the back 21; the seat unit 30 comprises a seat 31 and a rim 32; the fastening member 80 penetrates from the rear surface of the rim 32 through the inside of the seat 31 to the front surface of the rim 32, thereby being inserted in the seat 31 in its forward-backward direction to act as the axis of rotation of the seat unit 30 in its left-right direction for the seat unit 30 to be integrated inside the internal frame 20 so that the seat unit 30 can rotate from side to side; the horizontality maintaining means 40 is formed in the lower part of the seat unit 30 so as to keep the center of gravity of the horizontality maintaining means 40 in the vertically downward direction; and the internal frame 20 is integrated with the external frame 10, which is fixed on the hull floor, so that the internal frame 20 can rotate back and forth and the seat unit 30 inclines backward and forward according to the forward-backward rotation of the internal frame 20 to respond to pitching of the hull while the seat unit 30 is integrated with the internal frame 20 so that the seat unit 30 can rotate from side to side to respond to rolling of the hull by the action of the horizontality maintaining means 40.

In addition, the horizontality maintaining means 40 comprises an inverted quadrangular pyramidal frustum-shaped weight 41 and is formed in the lower part of the seat unit 30.

In addition, the inverted quadrangular pyramidal frustum-shaped weight 41 further has a quadrangular prism-shaped weight 42 in the lower part.

In addition, an upper magnet M is attached on the bottom surface of the inverted quadrangular pyramidal frustum-shaped weight 41 or the quadrangular prism-shaped weight 42; a support plate 90 which is paraboloid-shaped is formed on the hull floor beneath the seat unit 30; and each of lower magnets A, B, C and D is placed in the end part of the front, rear, left and right side, respectively, of the top surface of the support plate 90, wherein the one among the lower magnets A, B, C and D that is positioned nearest to the upper magnet M, which moves when the seat unit 30 inclines backward and forward and when the seat unit 30 rotates from side to side according to the forward-backward rotation of the internal frame 20, attracts the upper magnet M so that the center of gravity of the horizontality maintaining means 40, which is placed in the lower part of the seat unit 30, easily acts in the vertically downward direction. In addition, the diameter of the support plate 90 is not smaller than the width of the seat unit 30.

The chair for a ship with horizontality maintaining structure according to the present disclosure provides an advantageous effect of preventing passengers on board the ship from getting motion sickness by maintaining the horizontality of the chair installed in cabins and the like in response to wobbles of the ship. Moreover, it provides an advantageous effect of promoting dissemination of technology to maintain horizontality of chairs installed in cabins and the like in response to wobbles of the ship sailing on the sea because it has simple structure for easy manufacturing and manufacturing cost reduction.

These features, advantages and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments of the present invention. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Embodiment 1

Figure 1:
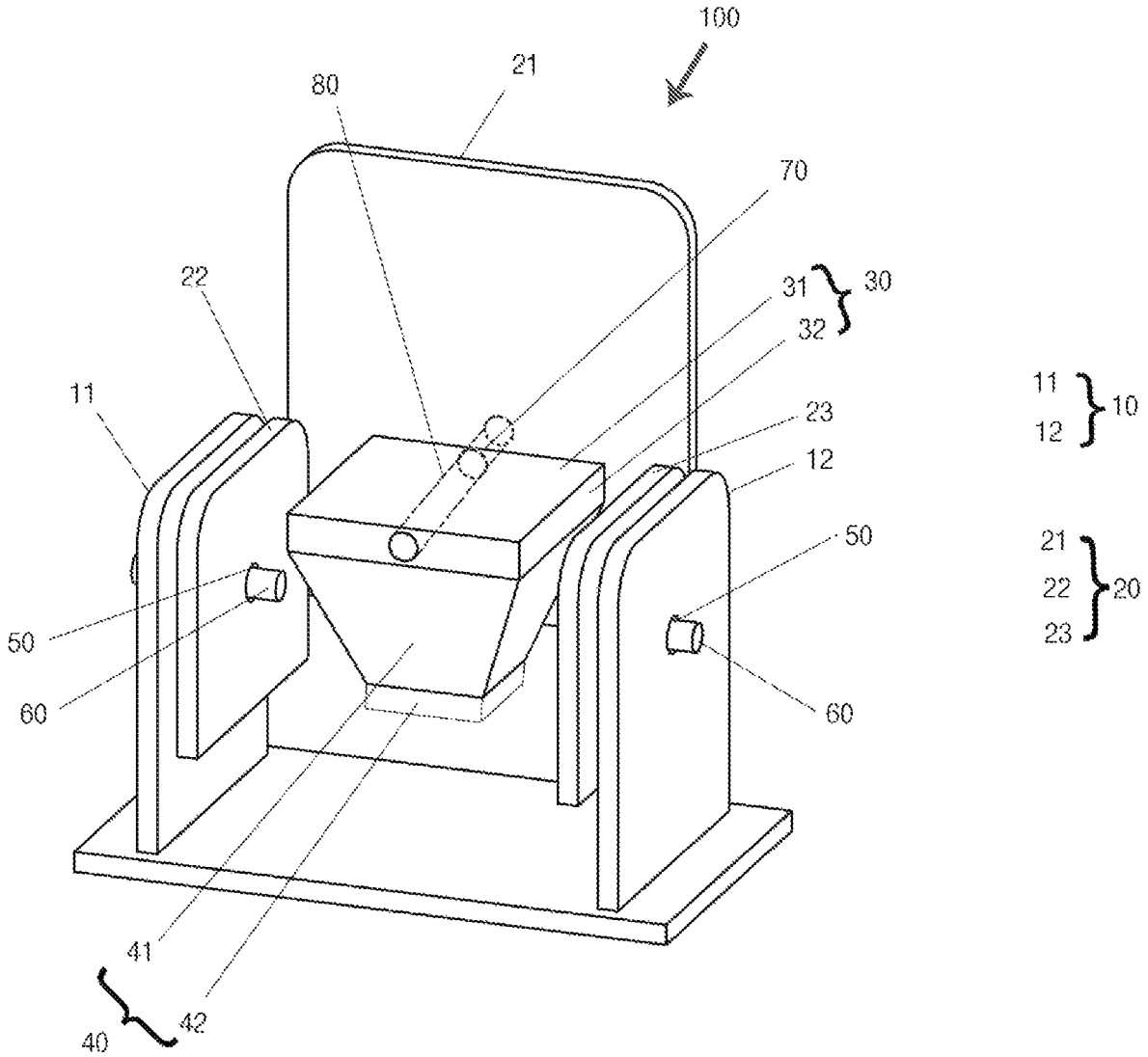
FIG. 1 is a drawing which describes the conditions of the chair for a ship with horizontality maintaining structure provided by the present disclosure according to Embodiment 1 of the present disclosure when the hull floor is horizontal.
Figure 2:
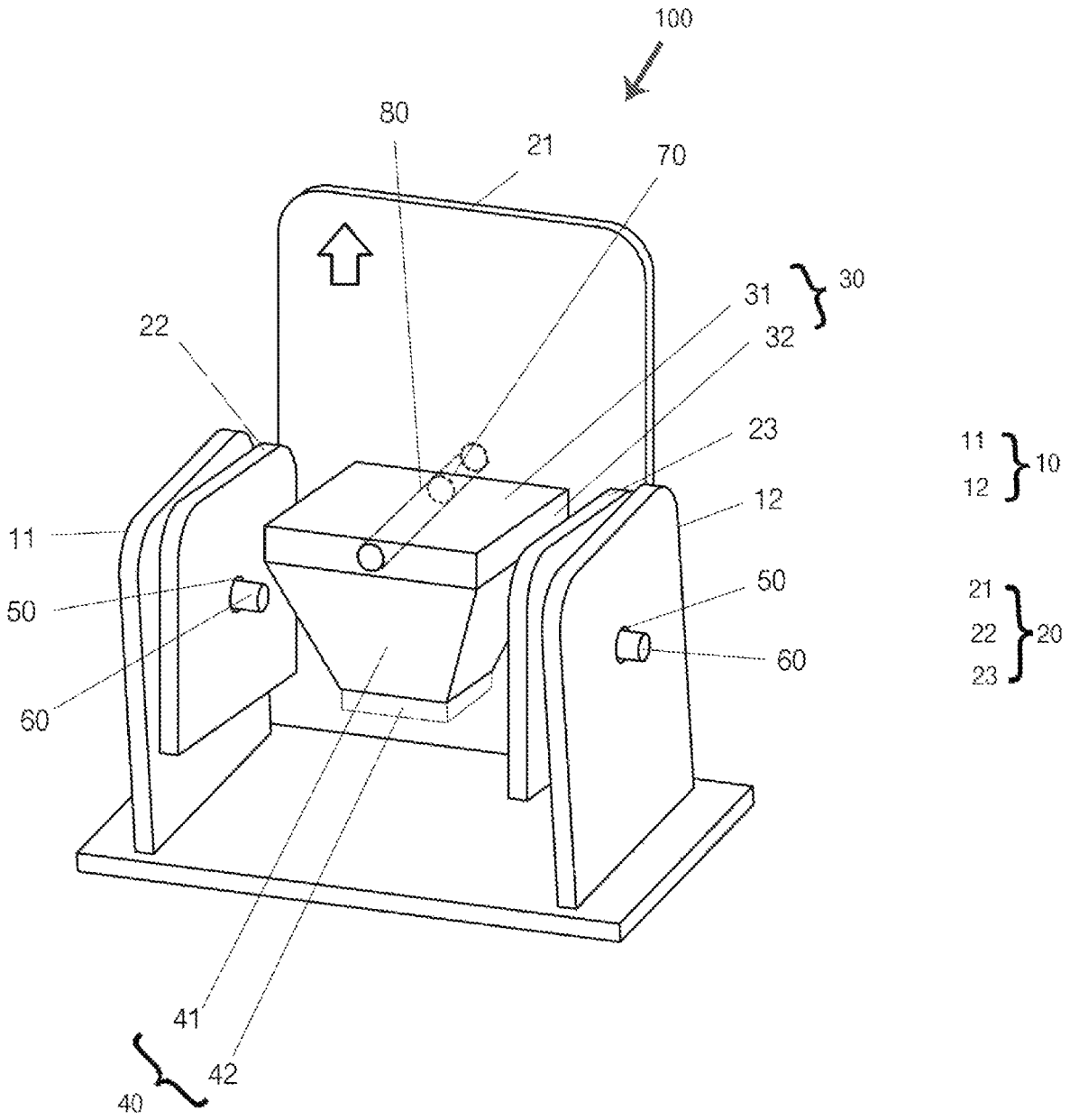
FIG. 2 is a drawing which describes the conditions of the chair for a ship with horizontality maintaining structure provided by the present disclosure according to Embodiment 1 of the present disclosure when the hull floor inclines forward because the bow descends downward while the stem ascends upward.
Figure 3:
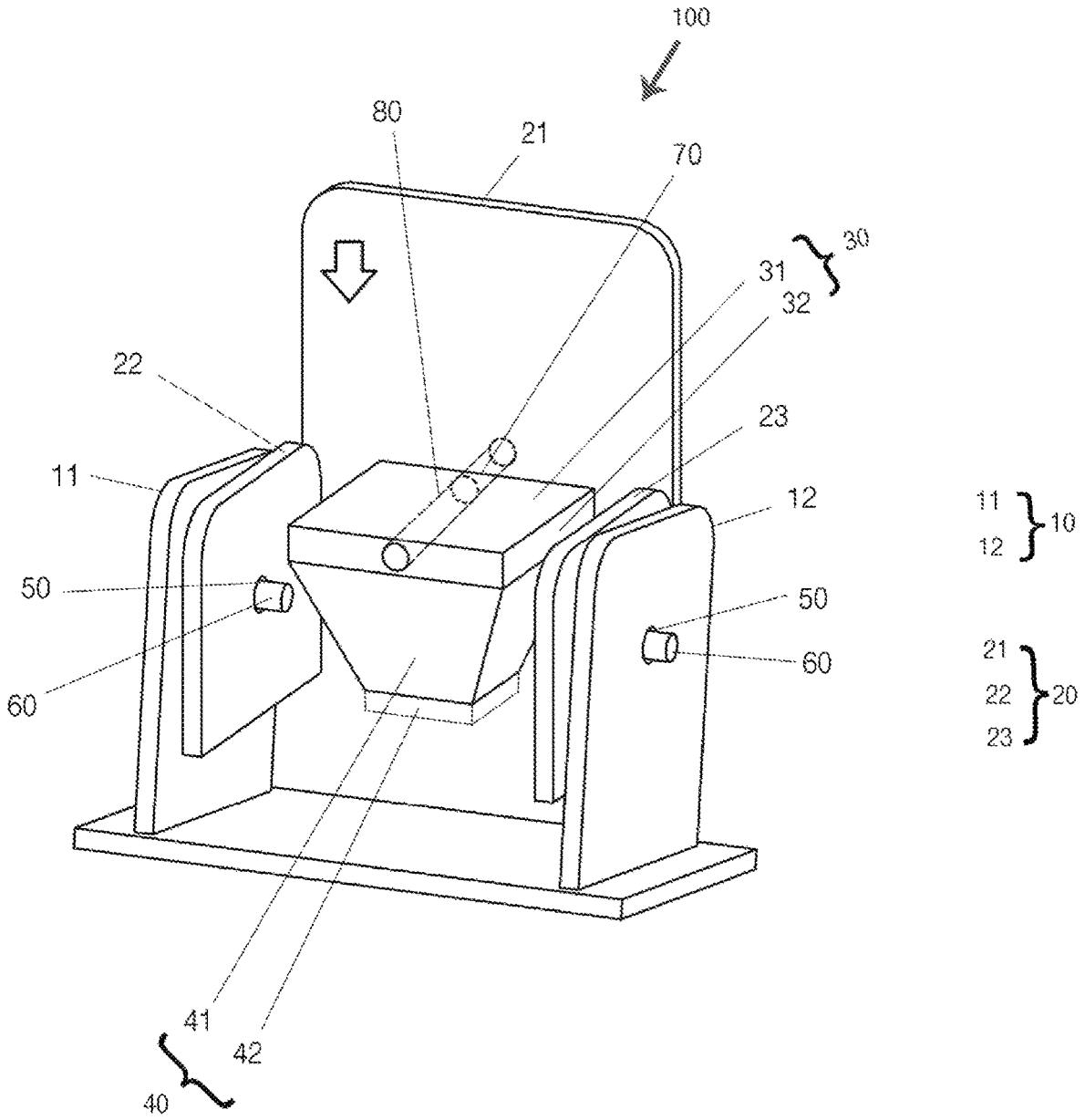
FIG. 3 is a drawing which describes the conditions of the chair for a ship with horizontality maintaining structure provided by the present disclosure according to Embodiment 1 of the present disclosure when the hull floor inclines backward because the bow ascends upward while the stern descends downward.
Figure 4:
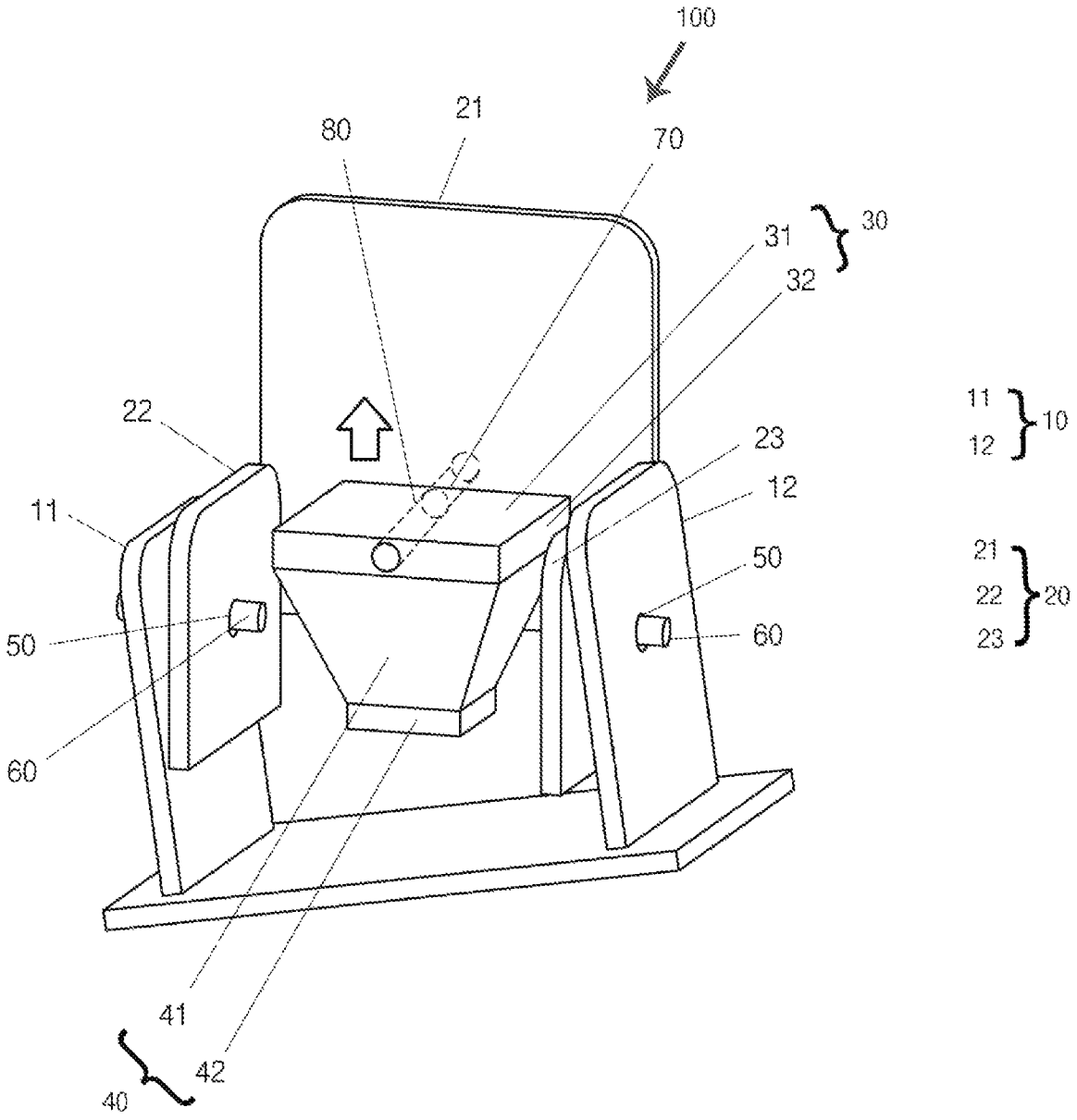
FIG. 4 is a drawing which describes the conditions of the chair for a ship with horizontality maintaining structure provided by the present disclosure according to Embodiment 1 of the present disclosure when the hull floor inclines leftward because the ship inclines leftward.
Figure 5:
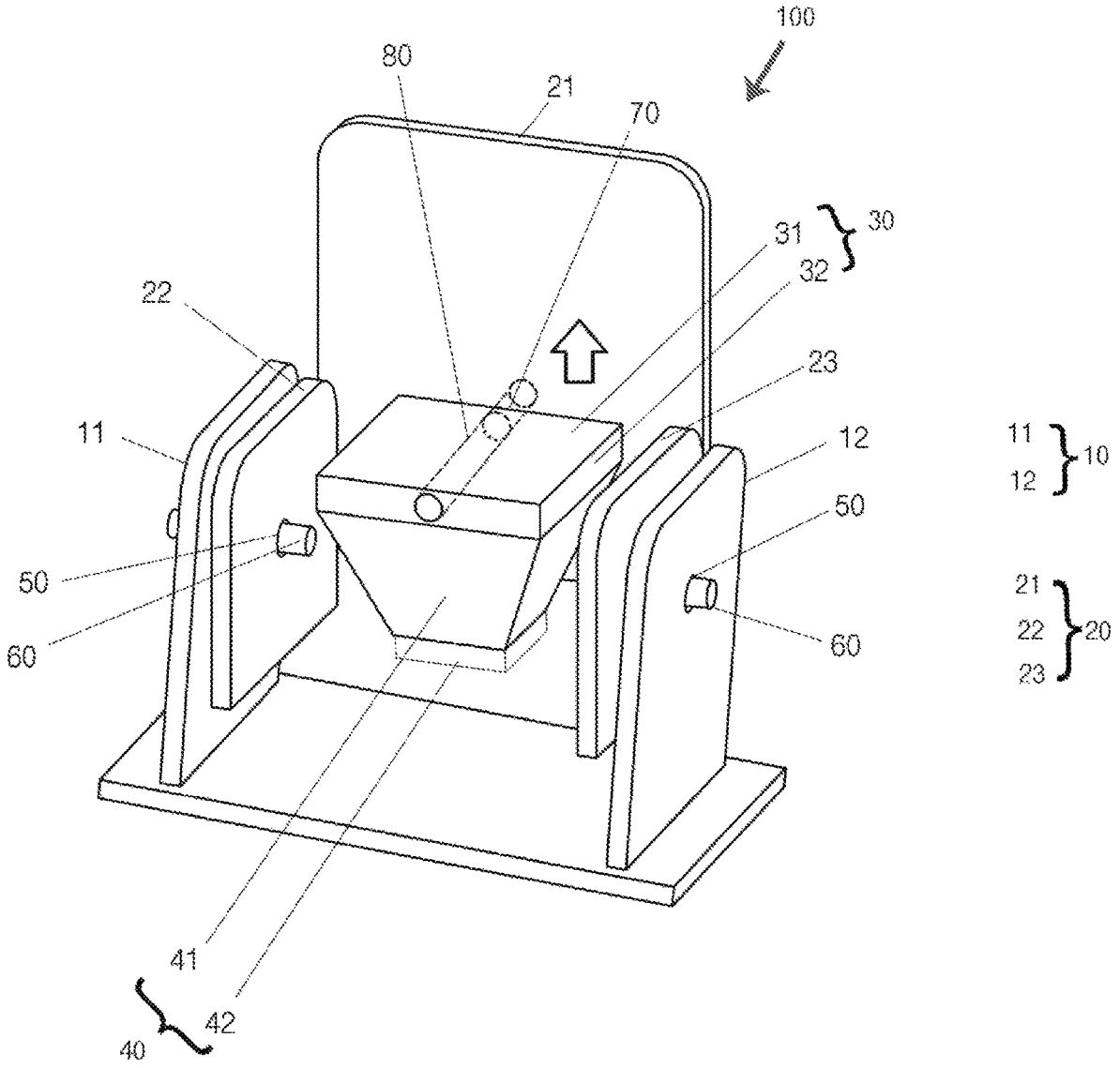
FIG. 5 is a drawing which describes the conditions of the chair for a ship with horizontality maintaining structure provided by the present disclosure according to Embodiment 1 of the present disclosure when the hull floor inclines rightward because the ship inclines rightward.

FIG. 1 is a drawing which describes the conditions of the chair for a ship with horizontality maintaining structure provided by the present disclosure according to Embodiment 1 of the present disclosure when the hull floor is horizontal. FIG. 2 is a drawing which describes the conditions of the chair for a ship with horizontality maintaining structure provided by the present disclosure according to Embodiment 1 of the present disclosure when the hull floor inclines forward because the bow descends downward while the stern ascends upward. FIG. 3 is a drawing which describes the conditions of the chair for a ship with horizontality maintaining structure provided by the present disclosure according to Embodiment 1 of the present disclosure when the hull floor inclines backward because the bow ascends upward while the stern descends downward. FIG. 4 is a drawing which describes the conditions of the chair for a ship with horizontality maintaining structure provided by the present disclosure according to Embodiment 1 of the present disclosure when the hull floor inclines leftward because the ship inclines leftward. FIG. 5 is a drawing which describes the conditions of the chair for a ship with horizontality maintaining structure provided by the present disclosure according to Embodiment 1 of the present disclosure when the hull floor inclines rightward because the ship inclines rightward.

As illustrated in FIGS. 1 through 5, the chair for a ship with horizontality maintaining structure 100 according to Embodiment 1 of the present disclosure includes the external frame 10 which is installed in a fixing way on the hull floor, the internal frame 20 which is integrated inside the external frame 10 so that it can rotate back and forth, the seat unit 30 which is integrated inside the internal frame 20 so that it can rotate from side to side and the horizontality maintaining means 40 which is formed in the lower part of the seat unit 30. Seen from the front side of the chair for a ship 100, the external frame 10 comprises the left member 11 which is installed in a fixing way on the hull floor and has the shape of a quadrangle plate and the right member 12 which has the same shape as that of the left member 11 and is installed in a fixing way on the hull floor with a certain distance from the left member 11 to be parallel with the left member 11.

The internal frame 20 comprises the back 21 which has the shape of a quadrangle plate, the left plate 22 which has the shape of a quadrangle plate and is installed in a fixing way on the left side of the back 21 so that the left plate protrudes therefrom and the right plate 23 which has the same shape as that of the left plate 22 and is installed in a fixing way on the right side of the back 21 so that the right plate protrudes therefrom.

The internal frame 20 is integrated between the left member 11 and the right member 12 of the external frame 10. The fastening hole 50 is formed at its predetermined corresponding location of the left member 11 of the external frame 10 and the left plate 22 of the internal frame 20 and the right member 12 of the external frame 10 and the right plate 23 of the internal frame 20, respectively, while the fastening member 60 is inserted through the fastening hole 50 for the internal frame 20 to be integrated inside the external frame 10 so that the internal frame 20 can rotate back and forth.

The fastening hole 70 is formed at its predetermined location at the center of the back 21 of the internal frame 20 while the fastening member 80 is inserted in the fastening hole 70 so that the seat unit 30 is integrated on the front side of the back 21.

The seat unit 30 comprises the seat 31 and the rim 32 while the fastening member 80 penetrates from the rear surface of the rim 32 through the inside of the seat 31 to the front surface of the rim 32, thereby being inserted in the seat 31 in its forward-backward direction to act as the axis of rotation of the seat unit 30 in its left-right direction for the seat unit 30 to be integrated inside the internal frame 20 so that the seat unit 30 can rotate from side to side. The horizontality maintaining means 40 is formed in the lower part of the seat unit 30 so as to keep the center of gravity of the horizontality maintaining means 40 in the vertically downward direction. By the action of the horizontality maintaining means 40, the internal frame 20 is integrated with the external frame 10, which is fixed on the hull floor, so that the internal frame 20 can rotate back and forth and the seat unit 30 inclines backward and forward according to the forward-backward rotation of the internal frame 20 to respond to pitching of the hull while the seat unit 30 is integrated with the internal frame 20 so that the seat unit 30 can rotate from side to side to respond to rolling of the hull.

The horizontality maintaining means 40 is now described below in detail in connection with accompanying drawings.

As illustrated in FIG. 1, the horizontality maintaining means 40 comprises an inverted quadrangular pyramidal frustum-shaped weight 41 and is formed in the lower part of the seat unit 30. A quadrangular pyramidal frustum is the remaining solid portion of a quadrangular pyramid when the pyramid is cut off with a plane parallel to its base plane and the portion on the apex side is taken off while an inverted quadrangular pyramidal frustum is a solid which has the shape of a quadrangular pyramidal frustum set upside down.

The inverted quadrangular pyramidal frustum-shaped weight 41 is appropriate for keeping the center of gravity of the horizontality maintaining means 40 in the vertically downward direction. The action of keeping the center of gravity of the horizontality maintaining means 40 in the vertically downward direction can be reinforced by further has the quadrangular prism-shaped weight 42 in the lower part of the inverted quadrangular pyramidal frustum-shaped weight 41.

Action and effects of the chair for a ship with horizontality maintaining structure according to Embodiment 1 is now described below in detail.

Seen from the front side in the direction the ship progresses in, as illustrated in FIG. 2, when the hull floor inclines forward, gravity acts on the horizontality maintaining means 40 in the vertically downward direction making the internal frame 20 rotate backward (in the direction of B) and, accordingly, the seat unit 30 inclines backward, thereby keeping the seat unit 30 horizontal.

As illustrated in FIG. 3, when the hull floor inclines backward, gravity acts on the horizontality maintaining means 40 in the vertically downward direction making the internal frame 20 rotate forward (in the direction of F) and, accordingly, the seat unit 30 inclines forward, thereby keeping the seat unit 30 horizontal.

As illustrated in FIG. 4, when the hull floor inclines leftward, gravity acts on the horizontality maintaining means 40 in the vertically downward direction making the seat unit 30 rotate and, accordingly, the seat unit 30 inclines rightward (in the direction of R), thereby keeping the seat unit 30 horizontal.

As illustrated in FIG. 5, when the hull floor inclines rightward, gravity acts on the horizontality maintaining means 40 in the vertically downward direction making the seat unit 30 rotate and, accordingly, the seat unit 30 inclines leftward (in the direction of L), thereby keeping the seat unit 30 horizontal.

When the hull floor inclines forward and also leftward, gravity acts on the horizontality maintaining means 40 in the vertically downward direction making the internal frame 20 rotate backward (in the direction of B), which makes the seat unit 30 incline backward, rotate and incline also rightward (in the direction of R), thereby keeping the seat unit 30 horizontal (Refer to FIGS. 2 and 4).

When the hull floor inclines forward and also rightward, gravity acts on the horizontality maintaining means 40 in the vertically downward direction making the internal frame 20 rotate backward (in the direction of B), which makes the seat unit 30 incline backward, rotate and incline also leftward (in the direction of L), thereby keeping the seat unit 30 horizontal (Refer to FIGS. 2 and 5).

When the hull floor inclines backward and also leftward, gravity acts on the horizontality maintaining means 40 in the vertically downward direction making the internal frame 20 rotate forward (in the direction of F), which makes the seat unit 30 incline forward, rotate and incline also rightward (in the direction of R), thereby keeping the seat unit 30 horizontal (Refer to FIGS. 3 and 4).

When the hull floor inclines backward and also rightward, gravity acts on the horizontality maintaining means 40 in the vertically downward direction making the internal frame 20 rotate forward (in the direction of F), which makes the seat unit 30 incline forward, rotate and incline also leftward (in the direction of L), thereby keeping the seat unit 30 horizontal (Refer to FIGS. 3 and 5).

As described thus far, because gravity acts on the horizontality maintaining means 40 in the vertically downward direction, the internal frame 20 and the seat unit 30 move in the direction opposite to that of wobbles of the ship, thereby keeping the seat unit 30 horizontal.

Embodiment 2

Figure 6:
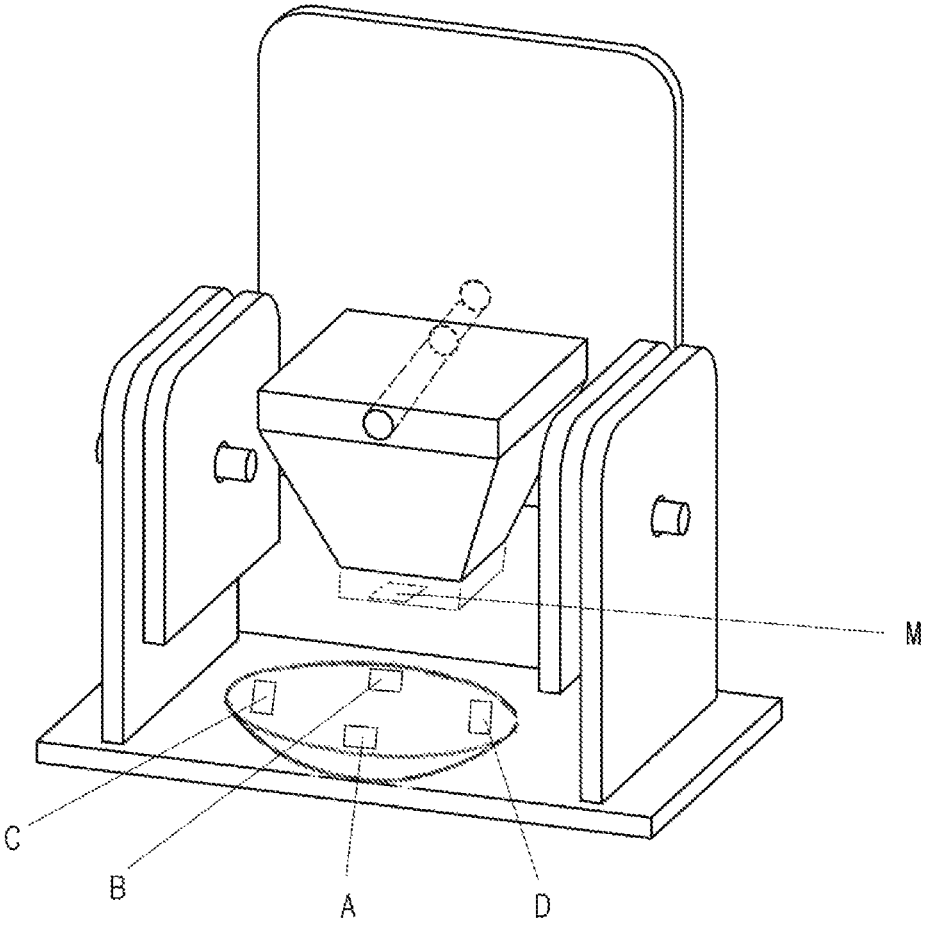
FIG. 6 is a drawing which describes the conditions of the chair for a ship with horizontality maintaining structure provided by the present disclosure according to Embodiment 2 of the present disclosure when the hull floor is horizontal.
Figure 7:
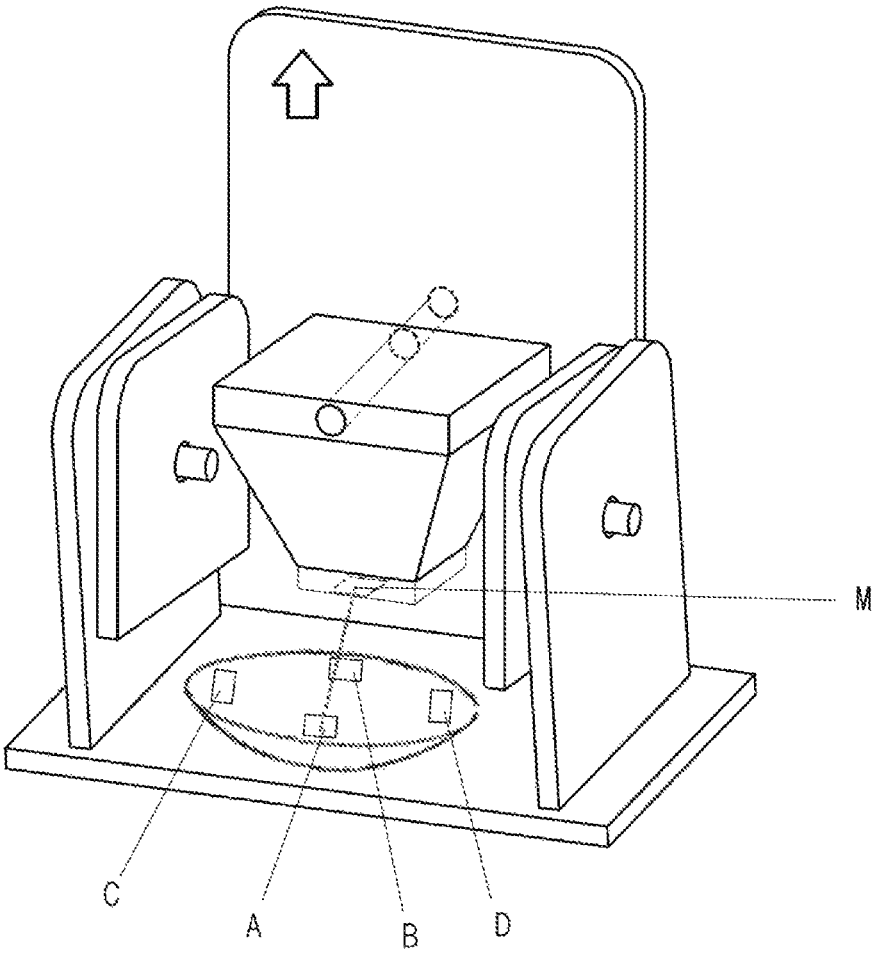
FIG. 7 is a drawing which describes the conditions of the chair for a ship with horizontality maintaining structure provided by the present disclosure according to Embodiment 2 of the present disclosure when the hull floor inclines forward because the bow descends downward while the stem ascends upward.
Figure 8:
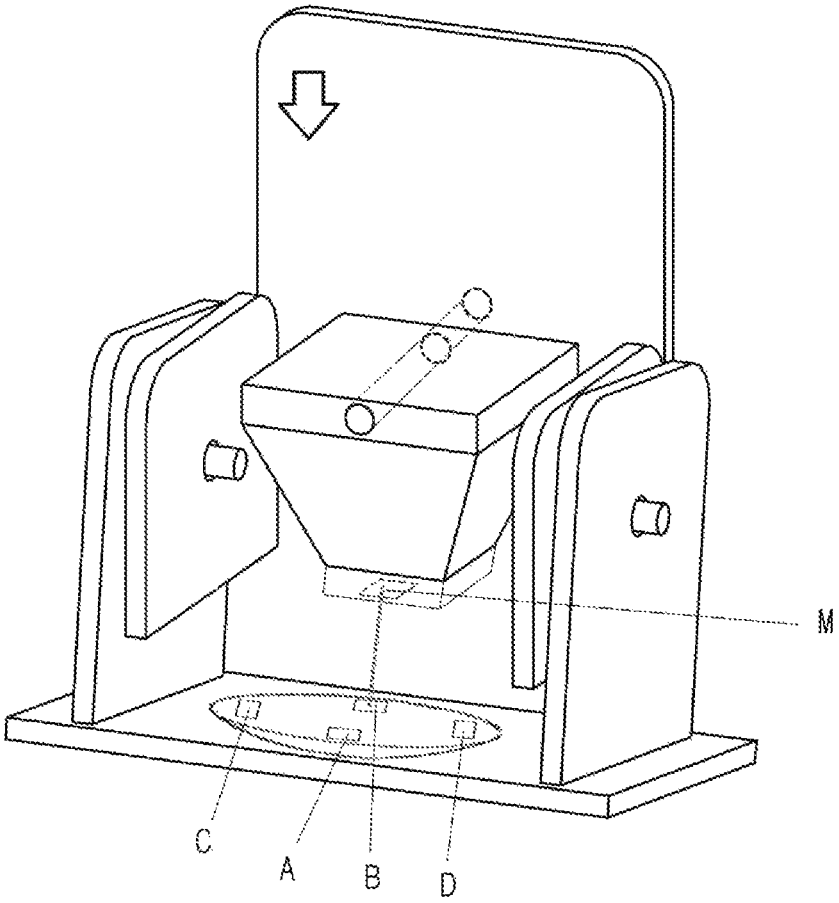
FIG. 8 is a drawing which describes the conditions of the chair for a ship with horizontality maintaining structure provided by the present disclosure according to Embodiment 2 of the present disclosure when the hull floor inclines backward because the bow ascends upward while the stern descends downward.
Figure 9:
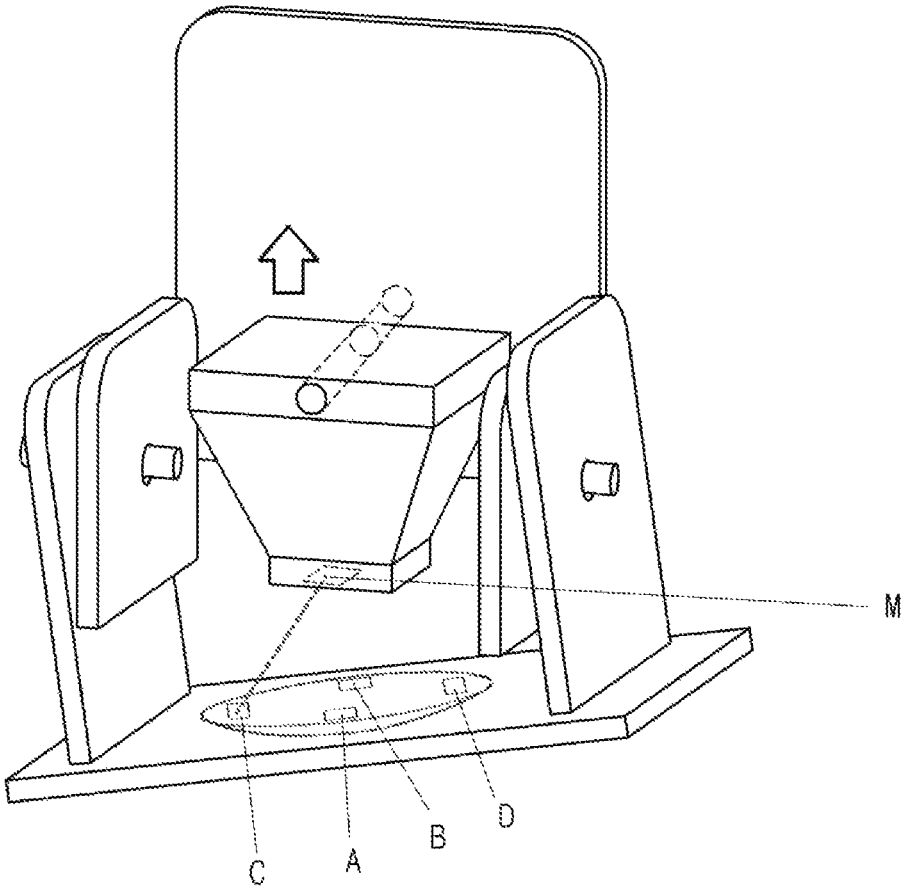
FIG. 9 is a drawing which describes the conditions of the chair for a ship with horizontality maintaining structure provided by the present disclosure according to Embodiment 2 of the present disclosure when the hull floor inclines leftward because the ship inclines leftward.
Figure 10:
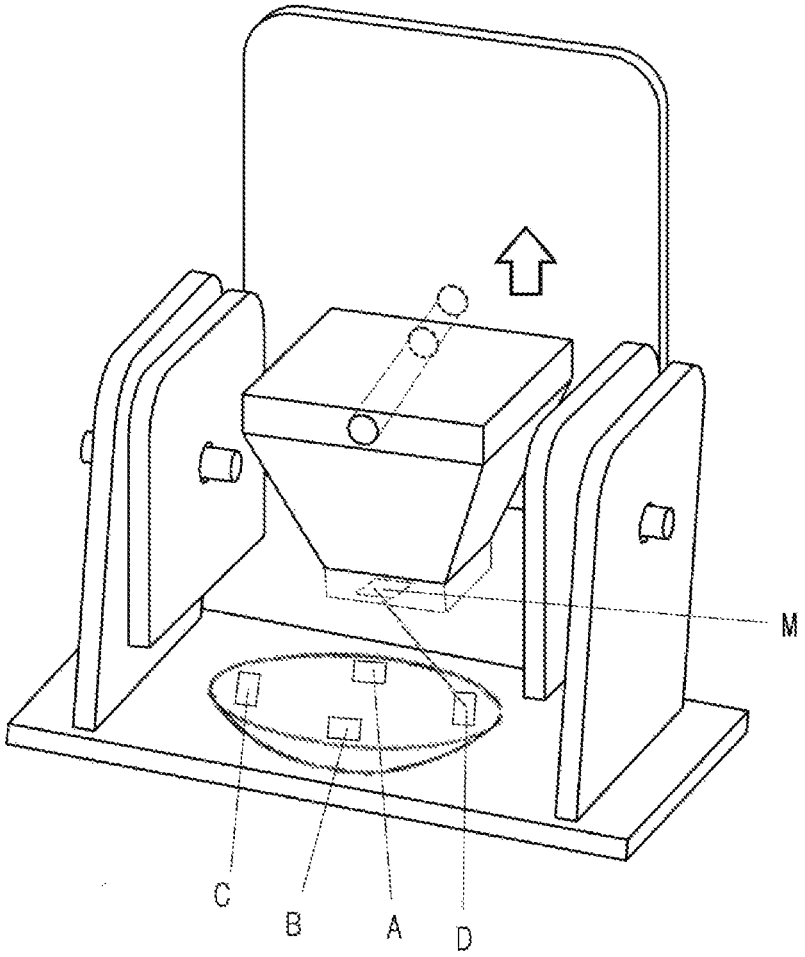
FIG. 10 is a drawing which describes the conditions of the chair for a ship with horizontality maintaining structure provided by the present disclosure according to Embodiment 2 of the present disclosure when the hull floor inclines rightward because the ship inclines rightward.

FIG. 6 is a drawing which describes the conditions of the chair for a ship with horizontality maintaining structure provided by the present disclosure according to Embodiment 2 of the present disclosure when the hull floor is horizontal. FIG. 7 is a drawing which describes the conditions of the chair for a ship with horizontality maintaining structure provided by the present disclosure according to Embodiment 2 of the present disclosure when the hull floor inclines forward because the bow descends downward while the stern ascends upward. FIG. 8 is a drawing which describes the conditions of the chair for a ship with horizontality maintaining structure provided by the present disclosure according to Embodiment 2 of the present disclosure when the hull floor inclines backward because the bow ascends upward while the stern descends downward. FIG. 9 is a drawing which describes the conditions of the chair for a ship with horizontality maintaining structure provided by the present disclosure according to Embodiment 2 of the present disclosure when the hull floor inclines leftward because the ship inclines leftward. FIG. 10 is a drawing which describes the conditions of the chair for a ship with horizontality maintaining structure provided by the present disclosure according to Embodiment 2 of the present disclosure when the hull floor inclines rightward because the ship inclines rightward.

Embodiment 2 according to the present disclosure has the same components as those of Embodiment 1 save for the horizontality maintaining means 40.

As illustrated in FIG. 6, the horizontality maintaining means 40 of Embodiment 2 according to the present disclosure comprises, as in Embodiment 1, the inverted quadrangular pyramidal frustum-shaped weight 41 and is formed in the lower part of the seat unit 30 while the inverted quadrangular pyramidal frustum-shaped weight 41 can further have the quadrangular prism-shaped weight 42 in the lower part.

When the horizontality maintaining means 40 comprises only the inverted quadrangular pyramidal frustum-shaped weight 41, the inverted quadrangular pyramidal frustum-shaped weight 41 has a magnet attached on the bottom surface, which becomes the upper magnet M. When the quadrangular prism-shaped weight 42 is also comprised as the horizontality maintaining means 40, the quadrangular prism-shaped weight 42 has a magnet attached on the bottom surface, which becomes the upper magnet M.

The hull floor beneath the seat unit 30 has the support plate 90. The support plate 90 is formed in the shape of a paraboloid and has a paraboloid corresponding to the cylindrical surface the upper magnet M draws when the seat unit 30 inclines backward and forward and when the seat unit 30 rotates from side to side according to the forward-backward rotation of the internal frame 20.

A magnet is placed in the end part of the front, rear, left and right side, respectively, of the top surface of the support plate 90, which becomes the lower magnet (A: the magnet placed at the front end; B: the magnet placed at the rear end; C: the magnet placed at the left end; and D: the magnet placed at the right end). A magnet has its N and S pole, where the same poles attract and the opposite poles repel each other. In Embodiment 2, the lower magnets A, B, C and D exert attraction on the upper magnet M.

The one among the lower magnets A, B, C and D that is positioned nearest to the upper magnet M, which moves when the seat unit 30 inclines backward and forward and when the seat unit 30 rotates from side to side according to forward-backward rotation of the internal frame 20, attracts the upper magnet M so that the center of gravity of the horizontality maintaining means 40, which is placed in the lower part of the seat unit 30, easily acts in the vertically downward direction.

If the support plate 90 has a diameter smaller than the width of the seat unit 30, thereby making the lower magnets A, B, C and D attached at the front, rear, left and right ends of the top surface of the support plate 90 be too close to each other, they can attract the upper magnet M before the center of gravity of the horizontality maintaining means 40 reaches in the vertically downward direction by the effect of gravity, thereby rather prohibiting the center of gravity of the horizontality maintaining means 40 from reaching in the vertically downward direction. Therefore, it is desirable the diameter of the support plate 90 is not smaller than the width of the seat unit 30.

It is desirable that permanent magnets, which have magnetism in the long term, are prepared for the upper magnet M and the lower magnets A, B, C and D and that neodymium magnets, whose magnetism is the strongest, are prepared for this purpose.

Action and effects of the chair for a ship with horizontality maintaining structure according to Embodiment 2 is now described below in detail.

Seen from the front side in the direction the ship progresses in, as illustrated in FIG. 7, when the hull floor inclines forward, gravity acts on the horizontality maintaining means 40 in the vertically downward direction making the internal frame 20 rotate backward (in the direction of B) and, accordingly, the seat unit 30 inclines backward. Here, the lower magnet A attached at the front end of the top surface of the support plate 90 attracts the upper magnet M so that the center of gravity of the horizontality maintaining means 40 easily acts in the vertically downward direction, thereby keeping the seat unit 30 horizontal.

As illustrated in FIG. 8, when the hull floor inclines backward, gravity acts on the horizontality maintaining means 40 in the vertically downward direction making the internal frame 20 rotate forward (in the direction of F) and, accordingly, the seat unit 30 inclines forward. Here, the lower magnet B, attached at the rear end of the top surface of the support plate 90, attracts the upper magnet M so that the center of gravity of the horizontality maintaining means 40 easily acts in the vertically downward direction, thereby keeping the seat unit 30 horizontal.

As illustrated in FIG. 9, when the hull floor inclines leftward, gravity acts on the horizontality maintaining means 40 in the vertically downward direction making the seat unit 30 rotate and, accordingly, the seat unit 30 inclines rightward (in the direction of R). Here, the lower magnet C, attached at the left end of the top surface of the support plate 90, attracts the upper magnet M so that the center of gravity of the horizontality maintaining means 40 easily acts in the vertically downward direction, thereby keeping the seat unit 30 horizontal.

As illustrated in FIG. 10, when the hull floor inclines rightward, gravity acts on the horizontality maintaining means 40 in the vertically downward direction making the seat unit 30 rotate and, accordingly, the seat unit 30 inclines leftward (in the direction of L). Here, the lower magnet D, attached at the right end of the top surface of the support plate 90, attracts the upper magnet M so that the center of gravity of the horizontality maintaining means 40 easily acts in the vertically downward direction, thereby keeping the seat unit 30 horizontal.

When the hull floor inclines forward and also leftward, gravity acts on the horizontality maintaining means 40 in the vertically downward direction making the internal frame 20 rotate backward (in the direction of B), which makes the seat unit 30 incline backward, rotate and incline also rightward (in the direction of R). Here, the lower magnet A and the lower magnet C, attached at the front end and at the left end, respectively, of the top surface of the support plate, 90 attract the upper magnet M so that the center of gravity of the horizontality maintaining means 40 easily acts in the vertically downward direction, thereby keeping the seat unit 30 horizontal (Refer to FIGS. 7 and 9).

When the hull floor inclines forward and also rightward, gravity acts on the horizontality maintaining means 40 in the vertically downward direction making the internal frame 20 rotate backward (in the direction of B), which makes the seat unit 30 incline backward, rotate and incline also leftward (in the direction of L). Here, the lower magnet A and the lower magnet D, attached at the front end and at the right end, respectively, of the top surface of the support plate 90, attract the upper magnet M so that the center of gravity of the horizontality maintaining means 40 easily acts in the vertically downward direction, thereby keeping the seat unit 30 horizontal (Refer to FIGS. 7 and 10).

When the hull floor inclines backward and also leftward, gravity acts on the horizontality maintaining means 40 in the vertically downward direction making the internal frame 20 rotate forward (in the direction of F), which makes the seat unit 30 incline forward, rotate and incline also rightward (in the direction of R). Here, the lower magnet B and the lower magnet C, attached at the rear end and at the left end, respectively, of the top surface of the support plate 90, attract the upper magnet M so that the center of gravity of the horizontality maintaining means 40 easily acts in the vertically downward direction, thereby keeping the seat unit 30 horizontal (Refer to FIGS. 8 and 9).

When the hull floor inclines backward and also rightward, gravity acts on the horizontality maintaining means 40 in the vertically downward direction making the internal frame 20 rotate forward (in the direction of F), which makes the seat unit 30 incline forward, rotate and incline also leftward (in the direction of L). Here, the lower magnet B and the lower magnet D, attached at the rear end and at the right end, respectively, of the top surface of the support plate 90, attract the upper magnet M so that the center of gravity of the horizontality maintaining means 40 easily acts in the vertically downward direction, thereby keeping the seat unit 30 horizontal (Refer to FIGS. 8 and 10).

As described thus far, as gravity acts on the horizontality maintaining means 40 in the vertically downward direction, the internal frame 20 and the seat unit 30 move in the direction opposite to that of wobbles of the ship and the lower magnets A, B, C and D attract the upper magnet M so that the center of gravity of the horizontality maintaining means 40, placed in the lower part of the seat unit 30, easily acts in the vertically downward direction, thereby keeping the seat unit 30 horizontal.

While particular embodiments of the present invention have been shown and described, it will be obvious to those of skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

REFERENCE CHARACTERS

100: Chair for a ship with horizontality maintaining structure according to the present disclosure
10: External frame
11: Left member
12: Right member
20: Internal frame
21: Back
22: Left plate
23: Right plate
30: Seat unit
31: Seat
32: Rim
40: Horizontality maintaining means
41: Inverted quadrangular pyramidal frustum-shaped weight
42: Quadrangular prism-shaped weight
50: Fastening hole
60: Fastening member
70: Fastening hole
80: Fastening member
90: Support plate
M: Upper magnet
A, B, C, D: Lower magnet

What is claimed is:

1. A chair for a ship with horizontality maintaining structure, including:
- an external frame which is installed in a fixing way on a hull floor;
- an internal frame which is integrated inside the external frame so that it rotates back and forth;
- a seat unit which is integrated inside the internal frame so that it rotates from side to side; and
- a horizontality maintaining means which is formed in the lower part of the seat unit, wherein the external frame comprises:
- a left member which is installed in a fixing way on the hull floor and has the shape of a quadrangle plate; and
- a right member which has the same shape as that of the left member and is installed in a fixing way on the hull floor at a distance from the left member to be parallel with the left member;

the internal frame comprises:
- a back which has the shape of a quadrangle plate, a left plate which has the shape of a quadrangle plate and is installed in a fixing way on the left side of the back so that the left plate protrudes therefrom; and
- a right plate which has the same shape as that of the left plate and is installed in a fixing way on the right side of the back so that the right plate protrudes therefrom;

the internal frame is integrated between the left member and the right member of the external frame;

a fastening hole is formed at a predetermined corresponding location of the left member of the external frame and the left plate of the internal frame and the right member of the external frame and the right plate of the internal frame, respectively;

a fastening member is inserted through the fastening hole for the internal frame to be integrated inside the external frame so that the internal frame rotates back and forth;

a second fastening hole is formed at a predetermined location at the center of the back of the internal frame while a second fastening member is inserted in the second fastening hole so that the seat unit is integrated on the front side of the back;

the seat unit comprises a seat and a rim;

the second fastening member penetrates from a rear surface of the rim through the inside of the seat to a front surface of the rim, thereby being inserted in the seat in a forward-backward direction to act as the axis of rotation of the seat unit in a left-right direction for the seat unit to be integrated inside the internal frame so that the seat unit rotates from side to side;

the horizontality maintaining means is formed in a lower part of the seat unit so as to keep the center of gravity of the horizontality maintaining means in a vertically downward direction; and the internal frame is integrated with the external frame, which is fixed on the hull floor, so that the internal frame rotates back and forth and the seat unit inclines backward and forward according to the forward-backward rotation of the internal frame to respond to pitching of the hull while the seat unit is integrated with the internal frame so that the seat unit rotates from side to side to respond to rolling of the hull by the action of the horizontality maintaining means.

2. The chair for a ship with horizontality maintaining structure of claim 1, wherein the horizontality maintaining means comprises an inverted quadrangular pyramidal frustum-shaped weight and is formed in the lower part of the seat unit.

3. The chair for a ship with horizontality maintaining structure of claim 2, wherein the inverted quadrangular pyramidal frustum-shaped weight further has a quadrangular prism-shaped weight in the lower part.

4. The chair for a ship with horizontality maintaining structure of claim 2, wherein an upper magnet is attached on the bottom surface of the inverted quadrangular pyramidal frustum-shaped weight;

a support plate which is paraboloid-shaped is formed on the hull floor beneath the seat unit; and each of lower magnets is placed in the end part of the front, rear, left and right side, respectively, of the top surface of the support plate, wherein a one among the lower magnets that is positioned nearest to the upper magnet, which moves when the seat unit inclines backward and forward and when the seat unit rotates from side to side according to the forward-backward rotation of the internal frame, attracts the upper magnet so that the center of gravity of the horizontality maintaining means, which is placed in the lower part of the seat unit, easily acts in the vertically downward direction.

5. The chair for a ship with horizontality maintaining structure of claim 3, wherein an upper magnet is attached on the bottom surface of the inverted quadrangular pyramidal frustum-shaped weight or the quadrangular prism-shaped weight;

a support plate which is paraboloid-shaped is formed on the hull floor beneath the seat unit; and each of lower magnets is placed in the end part of the front, rear, left and right side, respectively, of the top surface of the support plate, wherein a one among the lower magnets that is positioned nearest to the upper magnet, which moves when the seat unit inclines backward and forward and when the seat unit rotates from side to side according to the forward-backward rotation of the internal frame, attracts the upper magnet so that the center of gravity of the horizontality maintaining means, which is placed in the lower part of the seat unit, easily acts in the vertically downward direction.

6. The chair for a ship with horizontality maintaining structure of claim 4, wherein the diameter of the support plate is not smaller than the width of the seat unit.

7. The chair for a ship with horizontality maintaining structure of claim 5, wherein the diameter of the support plate is not smaller than the width of the seat unit.

* * * * *